US008006737B2

(12) United States Patent
Popa

(10) Patent No.: US 8,006,737 B2
(45) Date of Patent: Aug. 30, 2011

(54) FABRIC SQUARING CORRECTION FOR LATERAL ARM AWNING

(75) Inventor: Gheorghe Popa, El Paso, TX (US)

(73) Assignee: Dometic, LLC, Elkhart, IN (US)

( * ) Notice: Subject to any disclaimer, the term of this patent is extended or adjusted under 35 U.S.C. 154(b) by 267 days.

(21) Appl. No.: 11/498,642

(22) Filed: Aug. 3, 2006

(65) Prior Publication Data

US 2008/0029224 A1 Feb. 7, 2008

(51) Int. Cl.
*E04F 10/06* (2006.01)

(52) U.S. Cl. ..... 160/263; 160/323.1; 242/407; 242/573

(58) Field of Classification Search ..... 160/66, 160/67, 68, 22, 262, 263, 323.1, 324, 325; 135/88.11, 88.12, 68, 262, 324, 325; 242/376, 242/407, 407.1, 573, 573.2, 573.8; 403/298
See application file for complete search history.

(56) References Cited

U.S. PATENT DOCUMENTS

| | | | | | |
|---|---|---|---|---|---|
| 2,381,301 | A | * | 8/1945 | Markle, Jr. | 242/572 |
| 2,615,644 | A | * | 10/1952 | Enz | 242/573 |
| 3,064,452 | A | * | 11/1962 | Gast, Jr. | 464/184 |
| 3,248,899 | A | * | 5/1966 | Anderson | 464/184 |
| 3,362,461 | A | * | 1/1968 | Stark | 160/323.1 |
| 3,366,160 | A | * | 1/1968 | Anderson | 160/323.1 |
| 4,009,745 | A | * | 3/1977 | Erpenbeck | 160/297 |
| 4,729,418 | A | * | 3/1988 | Rude | 160/323.1 |
| 5,127,459 | A | * | 7/1992 | Markowitz | 160/263 |
| 5,462,105 | A | * | 10/1995 | Supernak | 160/323.1 |
| 5,615,725 | A | | 4/1997 | Ming-Shun | |
| 5,813,449 | A | * | 9/1998 | Patmore et al. | 160/370.22 |
| 5,881,792 | A | * | 3/1999 | Cheng | 160/263 |
| 5,934,354 | A | * | 8/1999 | Price et al. | 160/370.22 |
| 6,315,025 | B1 | | 11/2001 | Mabie | |
| 6,817,650 | B2 | | 11/2004 | Cupelli et al. | |
| 2004/0188034 | A1 | | 9/2004 | Powell et al. | |
| 2008/0110582 | A1 | * | 5/2008 | Rasmussen | 160/263 |

FOREIGN PATENT DOCUMENTS

DE 103 00 312 * 7/2004

OTHER PUBLICATIONS

Fiamma Awnings Operating Instructions, Fiamma, Inc. Mar. 2003, pp. 1-18.

* cited by examiner

*Primary Examiner* — David Purol
(74) *Attorney, Agent, or Firm* — Pearne & Gordon LLP

(57) ABSTRACT

An adjustment device for an awning is provided comprising an engagement member and a resilient adjustment member having an outer diameter. The outer diameter of the adjustment member is adapted to be selectively adjustable. A retainer element is provided to maintain a desired outer diameter. In one example, the resilient adjustment member can be adapted to engage the engagement member. In addition or alternatively, the engagement member can have a plurality of angular splines that are keyed into corresponding internal grooves of the adjustment member. In addition or alternatively, the resilient adjustment member can be adapted to splinably engage the engagement member. In addition or alternatively, the resilient adjustment member can have a plurality of support members and a plurality of flexible connectors, wherein each support member is connected to an adjacent support member by a flexible connector to form an enclosed cross-section.

26 Claims, 6 Drawing Sheets

FABRIC SQUARING CORRECTION FOR LATERAL ARM AWNING

FIELD OF THE INVENTION

The present invention relates generally to an adjustment device for an awning, and more specifically to an adjustment device for an awning adapted to adjust the awning canopy.

BACKGROUND OF THE INVENTION

Awnings are often used to protect a user from various natural conditions, such as the sun or rain. Awnings can be used with vehicles, such as, for example, recreational vehicles, boats, or the like, and can even be used with structures, such as a building, or the like. Awnings can be adapted to move between an extended position and a stowed position. For example, the awning fabric can be adapted to roll about a roll tube between the extended and stowed positions. However, unless an extended edge of the awning fabric is substantially parallel to the central axis of the roll tube, one portion of the awning fabric may roll up differently than another portion. Thus, there is a need for an adjustment device for an awning that can overcome this problem.

BRIEF SUMMARY OF THE INVENTION

The following presents a simplified summary of the invention in order to provide a basic understanding of some aspects of the invention. This summary is not an extensive overview of the invention. It is intended to identify neither key nor critical elements of the invention nor delineate the scope of the invention. Its sole purpose is to present some concepts of the invention in a simplified form as a prelude to the more detailed description that is presented later.

In accordance with an aspect of the present invention, an adjustment device for an awning is provided. The adjustment device comprises an engagement member having a plurality of angular splines and a resilient adjustment member having an outer diameter and being adapted to engage the engagement member. The angular splines are keyed into corresponding internal grooves of the adjustment member. The outer diameter of the adjustment member is adapted to be selectively adjustable. A retainer element is further provided that is adapted to maintain a desired outer diameter of the adjustment member.

In accordance with another aspect of the present invention, an adjustment device for an awning is provided. The adjustment device comprises an engagement member and a resilient adjustment member having an outer diameter and being adapted to engage the engagement member. The adjustment member includes a plurality of support members and a plurality of flexible connectors. Each support member is connected to an adjacent support member by a flexible connector to form an enclosed cross-section. The outer diameter of the adjustment member is adapted to be selectively adjustable. A retainer element is further provided that is adapted to maintain a desired outer diameter of the adjustment member.

In accordance with yet another aspect of the present invention, an adjustment device for an awning is provided. The adjustment device comprises an engagement member having a plurality of angular splines and a resilient adjustment member. The adjustment member includes an outer diameter, a plurality of support members and a plurality of flexible connectors. Each support member is connected to an adjacent support member by a flexible connector to form an enclosed cross-section. The angular splines are keyed into corresponding internal grooves of the adjustment member such that the resilient adjustment member is adapted to splinably engage the engagement member. The outer diameter of the adjustment member is adapted to be selectively adjustable. The adjustment device further includes a retainer element adapted to maintain a desired outer diameter of the adjustment member.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DESCRIPTION OF EXAMPLE EMBODIMENTS

Figure 1:
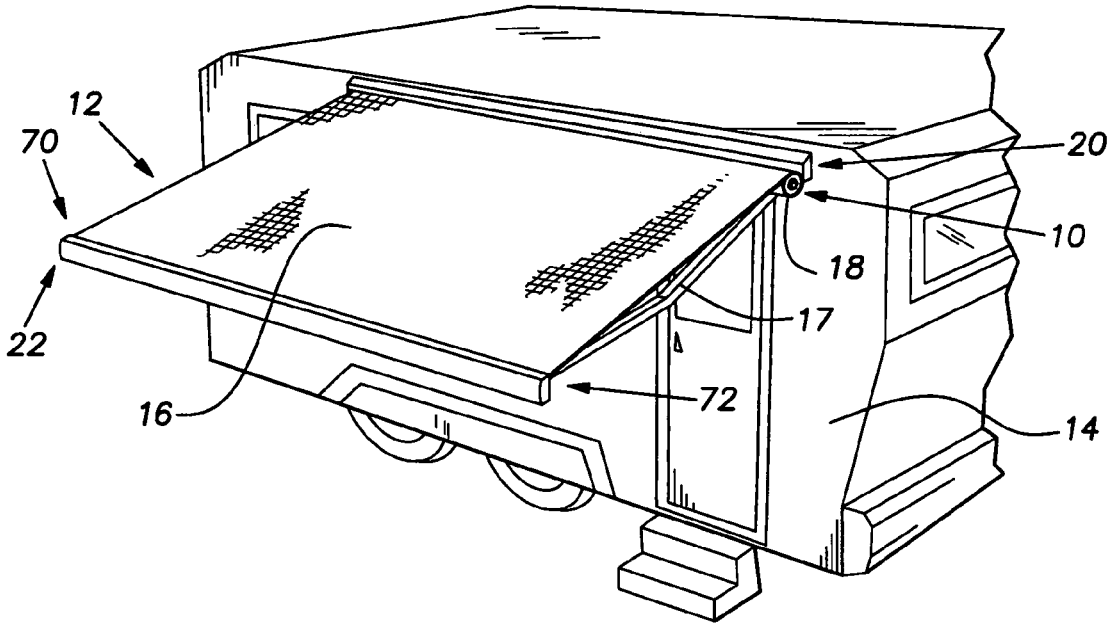
FIG. 1 is a perspective view of an adjustment device for an awning attached to an example recreational vehicle.

An example embodiment of an adjustment device that incorporates aspects of the present invention is shown in the drawings. It is to be appreciated that the shown example is not intended to be a limitation on the present invention. For example, one or more aspects of the present invention can be utilized in other embodiments and even other types of adjustment devices.

Turning to the shown example of FIG. 1, one example of an adjustment device 10 for an awning 12 is shown. The awning 12 can be used with vehicles, such as, for example, a recreational vehicle 14, boats (not shown), or the like, and it can even be used with structures, such as a building (not shown), or the like. The awning 12 can be adapted to move between an extended position, as shown in FIG. 1, to protect a user from various natural conditions, such as the sun or rain, and a stowed position (not shown) to protect the awning 12, such as during transport of the recreational vehicle 14.

In one example, the awning 12 can include a canopy 16 that can be adopted to roll and unroll about a roll tube 18 between the extended and stowed positions. As shown in FIG. 1, a first end 20 of the canopy 16, including the roll tube 18, can be attached to the recreational vehicle 14, while a second end 22 of the canopy 16 can be extended a distance from the recreational vehicle 14. Thus, when the canopy 16 is rolled or unrolled, the first end 20 remains fixed while the second end 22 moves a distance away from the first end 20. The awning 12 can also include one or more support arms (17, only one shown) adapted to provide support for the canopy 16 while it is in an extended position. The support arms 17 can support the canopy 16 in various ways. For example, as shown, the support arms 17 can extend between a portion of the recreational vehicle 14 and the second end 22. In addition or alternatively, the support arms can extend between the second end 22 and the ground to provide additional support. In addition or alternatively, the awning 12 can include a housing 15 attached to the recreational vehicle 14 that is adapted to protect the roll tube 18.

Figure 2:
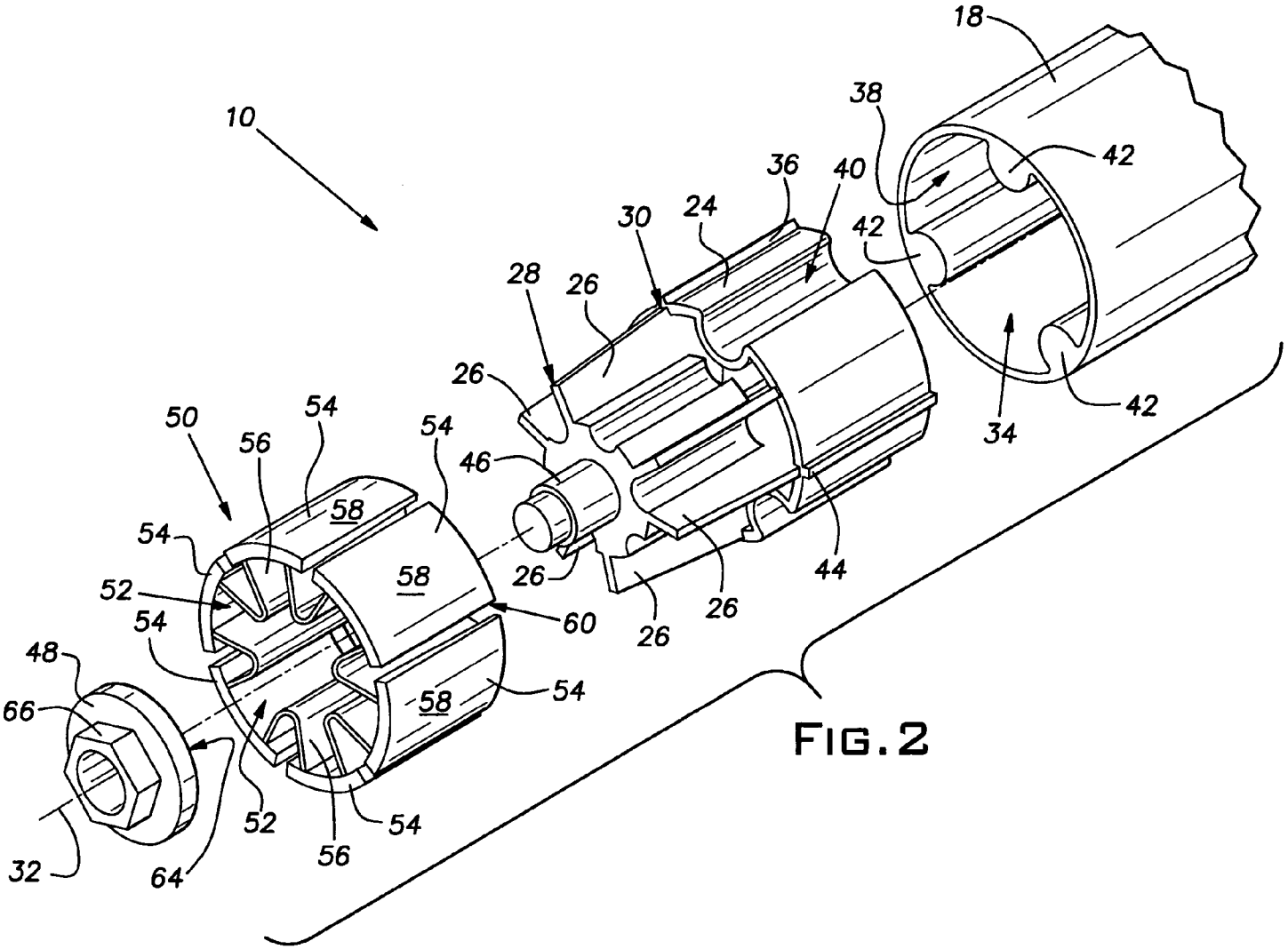
FIG. 2 is a perspective, exploded view of the adjustment device of FIG. 1.

Turning now to the example shown in FIG. 2, the adjustment device 10 for the awning 12 is shown. The adjustment device 10 can include an engagement member 24 having a plurality of angular splines 26. As shown, six angular splines 26 are arranged about a periphery of the engagement member 24, though any number of splines 26 can be used. Additionally, the angular splines 26 can include a ramped geometry such that the height of each spline 26 increases gradually along its longitudinal extent between a first end 28 and a second end 30. It is to be appreciated that the height of each spline 26 can increase between the first end 28 and the second end 30 in various manners, such as linearly (as shown), exponentially, stepped, or the like.

The engagement member 24 can be adapted to attach to one end of the roll tube 18. As shown, the engagement member 24 is adapted to be received in an opening 34 disposed at one end of the roll tube 18. The engagement member 24 can be retained within the opening 34 of the roll tube 18 in various manners. For example, the engagement member 24 can include projections 36 extending away from its outer periphery that are adapted to abut the inner surface 38 of the roll tube 18 to thereby create an interference fit. In addition or alternatively, the engagement member 24 can be retained within the opening 34 by fasteners, adhesives, clamps, or by any other suitable method.

The engagement member 24 can include additional elements. For example, the engagement member 24 can include recessed portions 40 adapted to receive corresponding projections 42 that extend away from the inner surface 38 of the roll tube 18. As shown, three projections 42 are adapted to be received by three recessed portions 40 (two shown) to permit the engagement member 24 to rotate together with the roll tube 18. Although not shown, the engagement member 24 can include one or more stop portions adapted to ensure a proper insertion depth of the engagement member 24 within the opening 34 of the roll tube 18. For example, the end of one of the projections 36, such as the end of the projection 44 near the second end 30 of the spline 26, can protrude to act as a stop portion. Alternatively, one or more of the splines 26 may be sufficiently extended such that an end surface at the second end 30 acts as a stop portion. The stop portion, if provided, can limit the extent to which the engagement member 24 can be received within the opening 34 of the roll tube 18. Once the engagement member 24 is fully received within the opening 34 of the roll tube 18, the splines 26 can be located completely outside of the roll tube 18. Even further still, the engagement member 24 can include an anchor 46, such as, for example, a threaded component, that is adapted to engage a retainer element 48, as will be described more fully herein.

A resilient adjustment member 50 can be adapted to engage the engagement member 24. For example, the angular splines 26 of the engagement member 24 can be keyed into corresponding internal grooves 52 of the adjustment member 50. In addition, the adjustment device 10 can further include a resilient adjustment member 50 that can have an outer diameter (D) that can be selectively adjustable, as will be discussed more fully herein.

Figure 3A:
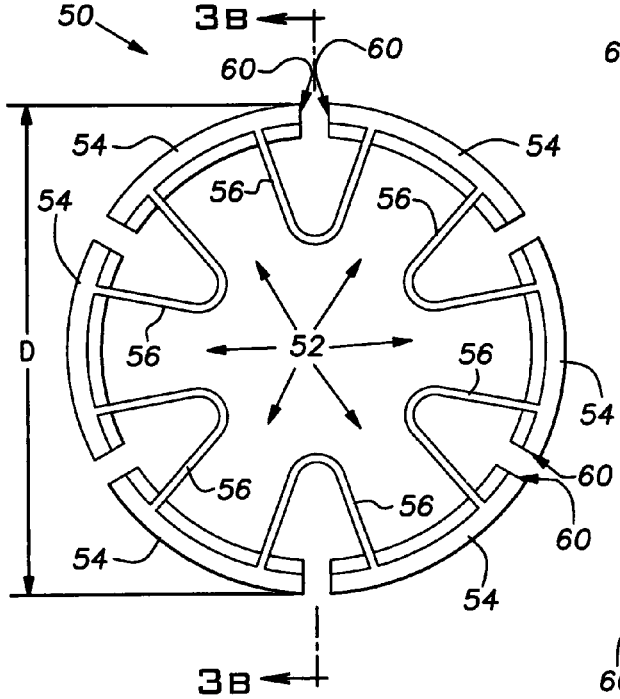
FIG. 3A is a front view of the example resilient adjustment member.
Figure 3B:
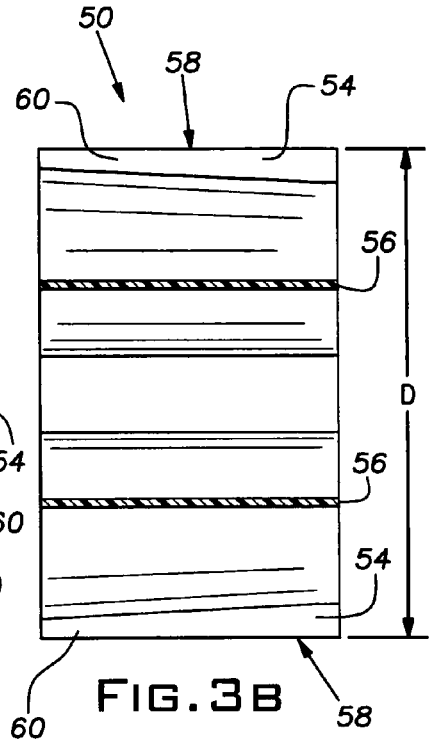
FIG. 3B is a sectional view along line 3B-3B of FIG. 3A.
Figure 3C:
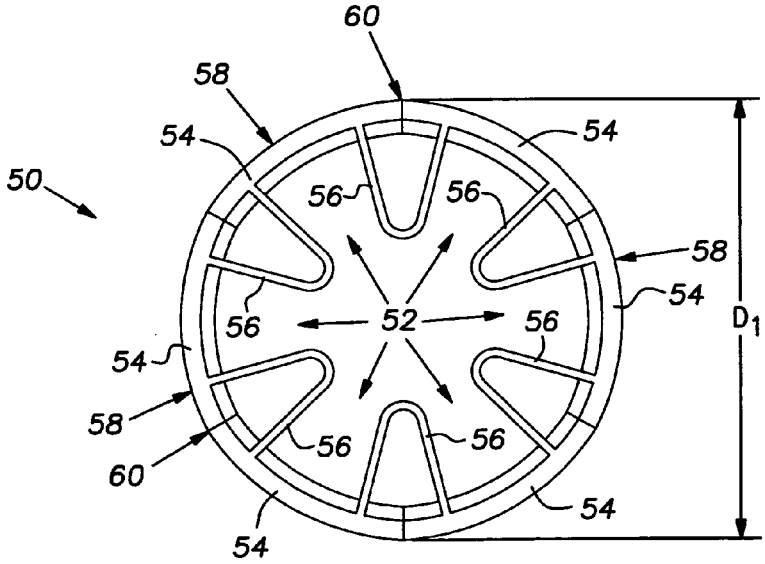
FIG. 3C is an alternative front view of the example resilient adjustment member.

Turning now to the examples shown in FIGS. 3A-3C, the adjustment member 50 can further comprise a plurality of support members 54 and a plurality of flexible connectors 56. The support members can have an arcuate outer surface 58 that is adapted to support a portion of the canopy 16 when it is wound around the roll tube 18. As shown, each support member 54 can be connected to an adjacent support member 54 by a flexible connector 56 to form an enclosed cross-section. Thus, though the adjustment member 50 can shrink and expand to selectively adjust the outer diameter (D), the cross-section can retain an enclosed cross-section, such as a substantially round shape. For example, as shown in FIG. 3A, when the adjustment member 50 expands, each of the support members 54 can move away from the central axis an approximately equal distance. In another example, as shown in FIG. 3C, when the adjustment member 50 contracts, each of the support members 54 can move towards the central axis an approximately equal distance.

Each flexible connector 56 can comprise a living hinge integrally connecting adjacent support members 54. That is, each flexible connector 56 can include relatively thin sections that connect two support members 54 to keep them together while still allowing selective adjustment of the outer diameter (D) of the adjustment member 50. For example, the flexible connectors 56 can include a flexible material that can withstand multiple flexure cycles without failure. In addition, the flexible connectors 56 can include a resilient material. Further, as shown, the flexible connectors 56 can be integrally formed with the support members 54, though they can also be attached in various other manners, such as by fasteners or adhesives, or the like. It is to be appreciated that some, or all, of the flexible connectors 56 can also comprise various other types of hinges that permit the outer diameter (D) to be selective adjustable. In addition, as shown in FIG. 3B, the flexible connectors 56 can extend along the entire distance as the support members 54, though some or all of the flexible connectors 56 can also extend various distances.

Figure 4A:
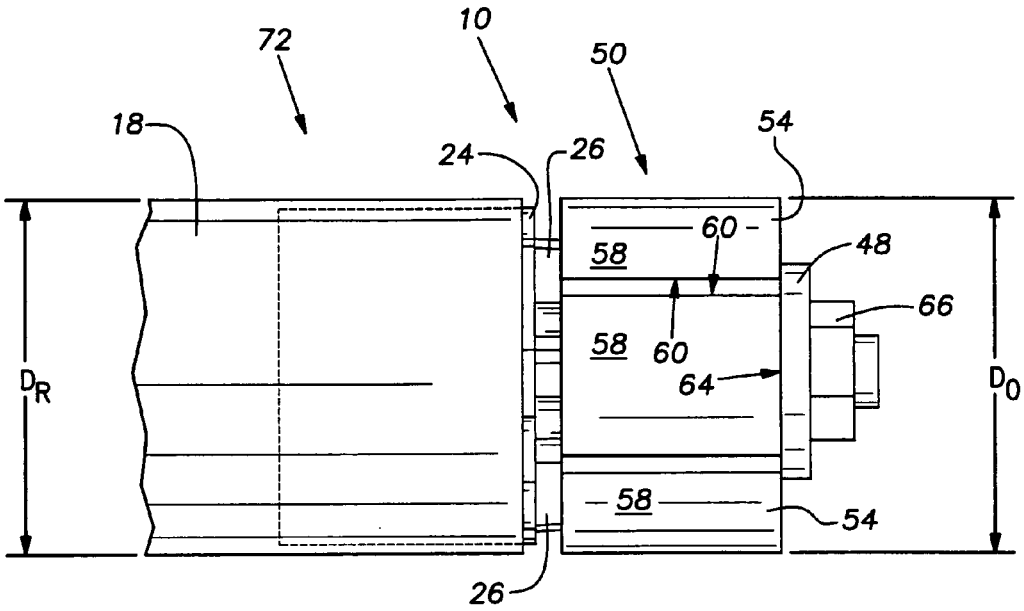
FIG. 4A is a side view of the example adjustment device including an example resilient adjustment member having a nominal outer diameter.
Figure 4B:
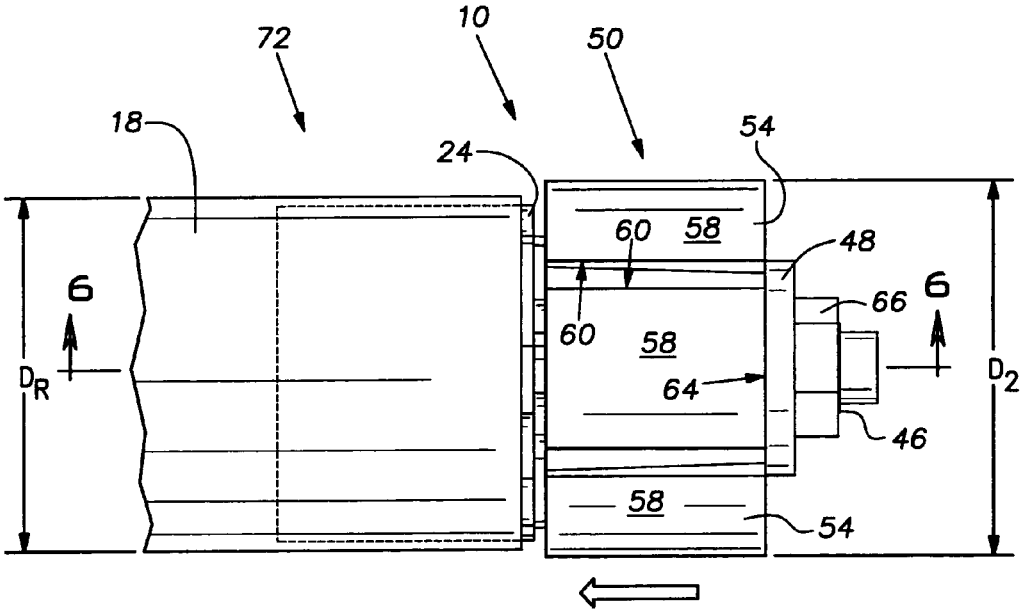
FIG. 4B is similar to FIG. 4A, but shows the resilient adjustment member having a larger outer diameter.
Figure 4C:
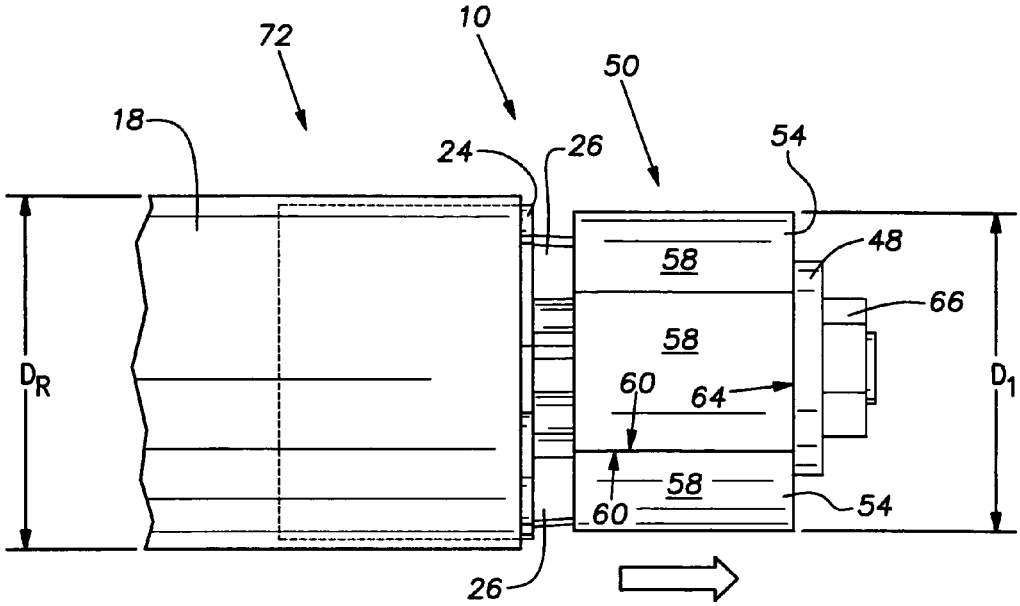
FIG. 4C is similar to FIG. 4A, but shows the resilient adjustment member having a smaller outer diameter.

Thus, the flexible connectors 56 can permit the adjacent support members 54 to selectively adjust the outer diameter (D) of the adjustment member from a minimum outer diameter ($D_1$), as shown in FIG. 4C, to a maximum outer diameter ($D_2$), as shown in FIG. 4B. In addition or alternatively, the adjustment member 50 can be resiliently biased towards the minimum outer diameter ($D_1$) such that each support member 54 abuts an adjacent support member 54. For example, as shown in FIG. 3C, each support member 54 can include an edge surface 60 such that the adjacent edge surfaces 60 abut each other. In one example, the adjustment member 50 can include resilient elements and/or material. Thus, the flexible connectors 56 can include a resilient material adapted to be resiliently bias the support members 54 towards each other. It is to be appreciated that the examples shown are not intended to provide a limitation upon the present invention, and that the minimum and maximum diameters ($D_1$, $D_2$) can be limited by various other variables, such as the components of the adjustment device 10 and/or the awning 12. For example, in operation, a stop portion of the engagement member 24 can limit the maximum diameter (D2).

Further, the flexible connectors 56 can define the sides of the internal grooves 52. For example, as previously stated, the angular splines 26 of the engagement member 24 can be keyed into corresponding internal grooves 52 of the adjustment member 50. Thus, as shown in FIG. 3A, the internal grooves 52 can be bounded by the flexible members 56, and can even be bounded by the support surfaces 54. However, the adjustment member 50 can also include additional structure adapted to define the internal grooves 52.

Returning now to FIG. 2, when the adjustment device 10 is assembled, the adjustment member 50 can be telescopically received by the engagement member 24. In addition or alternatively, the adjustment member 50 can be splinably engaged with the engagement member 24 to rotate together therewith. Thus, the splines 26 of the engagement member 24 can be telescopically received by the internal grooves 52 of the adjustment member 50. Turning briefly to FIG. 3B, each support member 54 can include a ramped geometry that corresponds to the gradually increasing height of the splines 26 to permit the adjustment member 50 to move freely relative to the engagement member 24. It is to be appreciated that if various splines 26 have various ramped geometries (e.g., various angles), various support members 54 can also have corresponding various ramped geometries.

Turning now to the examples shown in FIGS. 4A-4C, the outer diameter (D) of the adjustment member 50 can be selectively adjusted by telescopically moving the adjustment member 50 relative to the engagement member 24 in an axial direction substantially parallel to a central axis 32. For example, as shown in FIG. 4A, the adjustment member 50 can be received by the engagement member 24 in a nominal position such that the adjustment member 50 has a nominal outer diameter ($D_0$) that is substantially equal to the outer diameter ($D_R$) of the roll tube 18. Thus, as shown in FIG. 4B, by moving the adjustment member 50 towards the engagement member 24 (i.e., to the left in the drawing), the outer diameter (D) can increase until it reaches the maximum outer diameter ($D_2$). Similarly, as shown in FIG. 4C, by moving the adjustment member 50 away from the engagement member 24 (i.e., to the right in the drawing), the outer diameter (D) can decrease until it reaches the minimum outer diameter ($D_1$). Accordingly, the outer diameter (D) of the adjustment member 50 can be selectively adjusted to various diameters between the minimum outer diameter ($D_1$) and the maximum outer diameter ($D_2$) by telescopically moving the adjustment member 50 relative to the engagement member 24.

In addition, the retainer element 48 can be adapted to maintain a desired outer diameter (D) of the adjustment member 50. For example, the retainer element 48 can be adapted to engage the anchor 46 of the engagement member 24. As shown in FIGS. 4A-4C and 6, the retainer element 48 can include support structure, such as a support face 64, that is adapted to abut a portion of the adjustment member 50. As stated previously, because the adjustment member 50 can be resiliently biased towards the minimum outer diameter ($D_1$), it can naturally tend to move relative to the engagement member 24 (e.g., towards the right in the drawing) to achieve the minimum outer diameter ($D_1$). As such, the support face 64 of the retainer element 48 can abut the adjustment member 50 to thereby inhibit movement thereof. In one example, the retainer element 48 can prevent movement of the adjustment member 50. Accordingly, because the adjustment member 50 can be restrained against movement by the retainer element 48, a desired outer diameter (D) can be maintained.

Figure 5A:
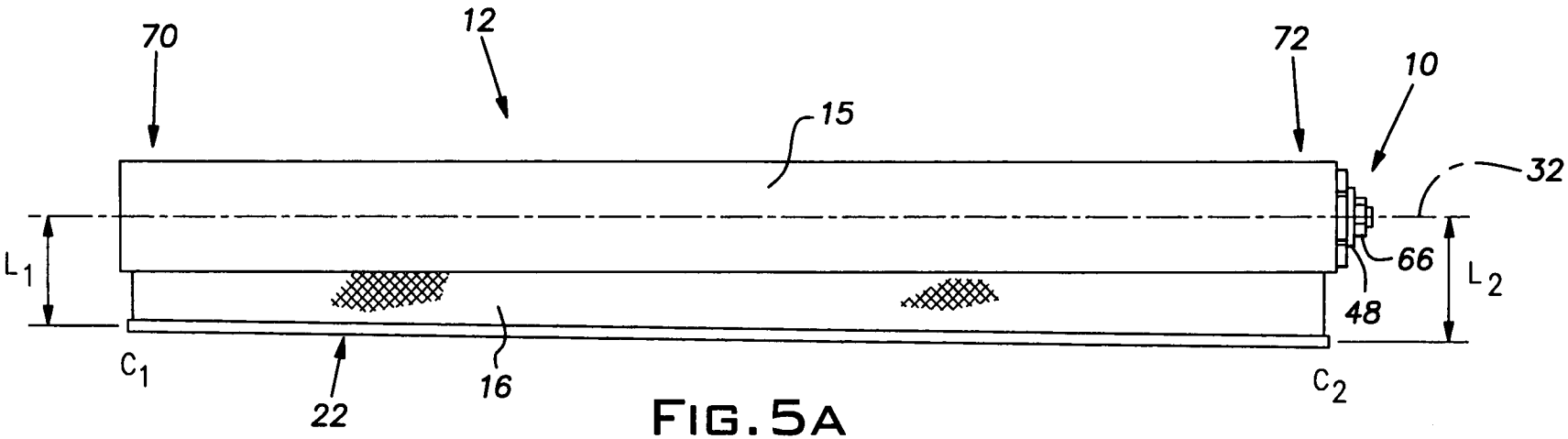
FIG. 5A is a top view of the awning showing an example awning fabric in a first configuration.
Figure 5B:
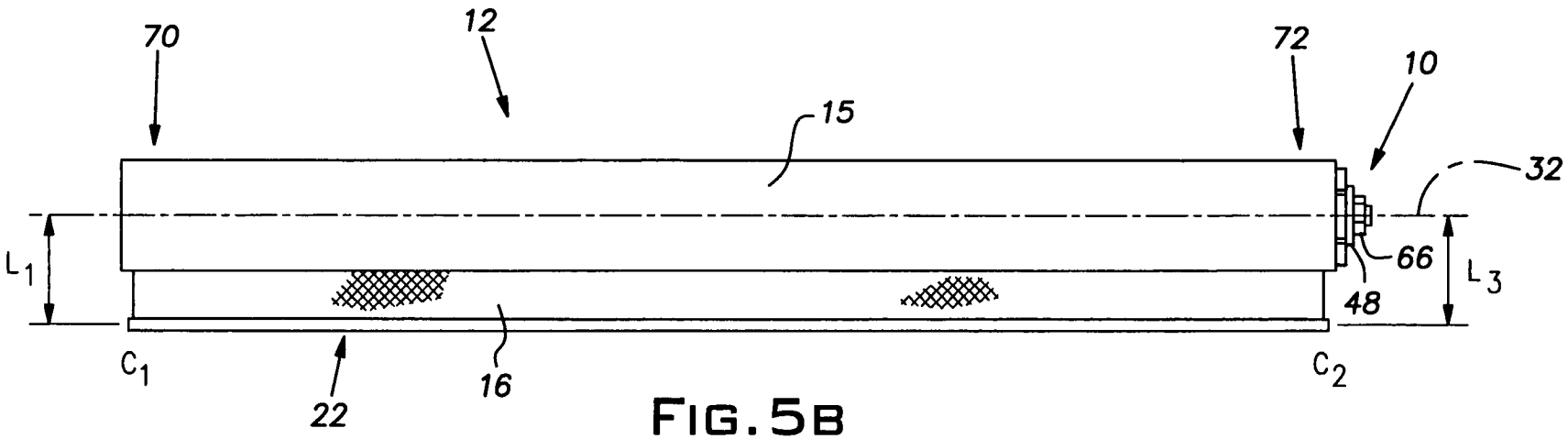
FIG. 5B is similar to FIG. 5A, but shows the awning fabric in a second configuration.

The retainer element 48 can engage the anchor 46 in various manners. In one example, the retainer element 48 can include a threaded fastener that can be adapted to engage the anchor 46. Thus, the anchor 46 can include external threaded structure, and the retainer element 48 can include corresponding internal threaded structure. As such, the location of the adjustment member 50 relative to the engagement member 24, and thus the outer diameter (D), can be selectively adjusted by threading the retainer element 48 more, or less, onto the anchor 46. Further still, the retainer element 48 can include grasping structure 66, such as a hex head, that can enable a user to selectively rotate the retainer element 48 to thread it onto the anchor 46. In addition or alternatively, the retainer element 48 can also include various other grasping structures 66, such as hand grips (not shown) adapted to permit a user to rotate the retainer element 48 by hand, or at least one hole to permit the user to manually rotate the retainer element 48 by using a spanner wrench, or the like. As shown in FIGS. 5A-5B, the grasping structure 66 can extend a distance from the adjustment device 10 even when the canopy 16 is rolled about the roll tube 18 to permit a user to make adjustments at various times. Even further still, the retainer element 48 can be retained on the anchor by a fastener (not shown), such as a nut, cotter pin, e-clip, or the like. It is to be appreciated that the foregoing description of the retainer element 48 is not intended to provide a limitation upon the present invention, and as such the adjustment device 10 can include various other devices adapted to maintain a desired outer diameter (D) of the adjustment member 50.

An example operation of the adjustment device 10 will now be described. As discussed previously herein, the canopy 16 can be adapted to roll about the roll tube 18 between the extended and stowed positions. However, unless the second end 22 (e.g., the extended edge) of the canopy 16 is substantially parallel to the central axis 32 of the roll tube 18, one portion of the canopy 16 may roll up differently than another portion. For example, the second end 22 may not be substantially parallel to the central axis 32 due to multiple roll and unroll cycles and/or age.

Turning to the example shown in FIG. 5A, when the awning 12 is substantially completely rolled up in the stowed position, a first corner ($C_1$) of the canopy 16 can extend a first distance ($L_1$) from the central axis 32, while a second corner ($C_2$) can extend a second distance ($L_2$) from the central axis 32. Thus, when the awning 12 is substantially completely rolled up in the stowed position, the second end 22 can be angled relative to the roll tube 18 if the second distance ($L_2$) is different than (e.g., greater than) the first distance ($L_1$). As such, the awning 12 can be unsightly, and can experience damage during transport. Accordingly, as shown in FIG. 5B, the adjustment device 10 of the present invention is adapted to correct for variations in the second distance ($L_2$) to enable it to be substantially equal to the first distance ($L_1$).

Figure 6:
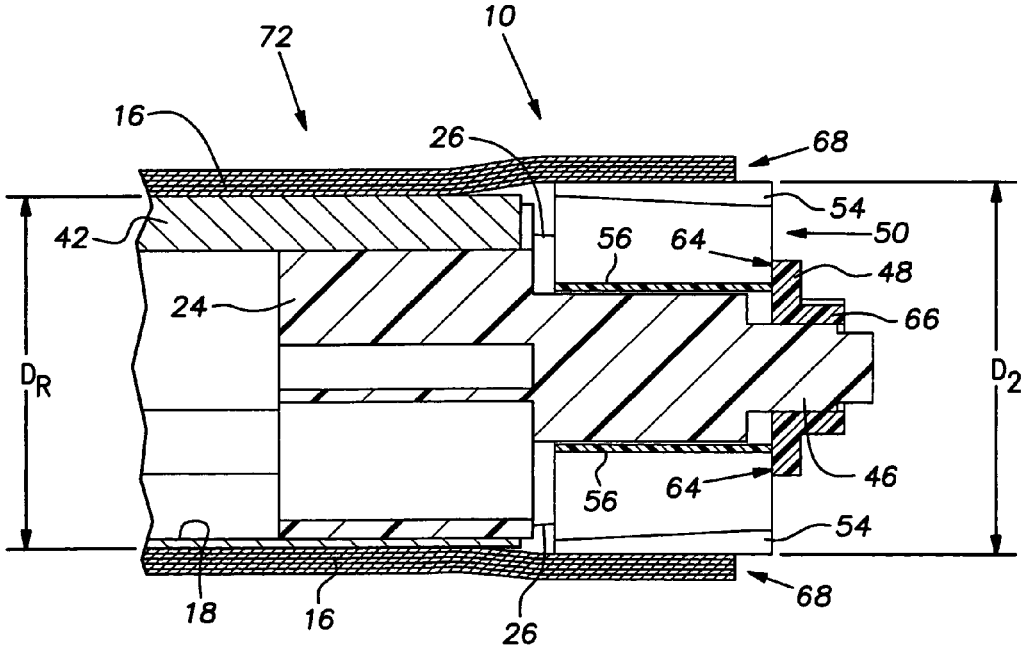
FIG. 6 is a sectional view along line 6-6 of FIG. 4B.

Turning now to the example shown in FIG. 6, as the roll tube 18 is rotated, the canopy 16 will roll up about the roll tube 18. As the canopy 16 is rolled, various layers 68 of the canopy 16 can accumulate on the outer diameter ($D_R$) of the roll tube 18. If it is desired to correct for a condition similar to that shown in FIG. 5A, such as where the second distance ($L_2$) is greater than the first distance ($L_1$), then a substantially equal amount of canopy 16 must be rolled about the first roll end 70 and the second roll end 72. Thus, to ensure substantially equal amounts of canopy 16 roll about the roll ends 70, 72, the adjustment device 52 can be adjusted to increase and/or decrease the diameter (D) about which the canopy 16 is rolled up.

As shown in FIG. 6, the outer diameter (D) of the adjustment device 52 can be increased relative to the diameter ($D_R$) of the roll tube 18. For example, the outer diameter (D) can be increased to the maximum outer diameter ($D_2$). Thus, because the diameter has been increased, more of the canopy 16 will collect on the second roll end 72 relative to the first roll end 70 when it is rolled up about the roll tube 18. Accordingly, as shown in FIG. 6B, after correction is made by the adjustment device 10, the second corner ($C_2$) can extend a third distance ($L_3$) from the central axis 32 that is substantially equal to the first distance ($L_1$) of the first corner ($C_1$) such that the second end 22 (e.g., the extended edge) of the canopy 16 is substantially parallel to the central axis 32 of the roll tube 18. Of course, this process may be repeated as necessary to ensure that the distance of the second corner ($C_2$) is substantially equal to the distance of the first corner ($C_1$). It is to be appreciated that, conversely, if the first distance ($L_1$) of the first corner ($C_1$) is less than the second distance ($L_2$) of the second corner ($C_2$) (e.g., the reverse of the above description), the outer diameter (D) of the adjustment member 50 can be decreased to permit more of the canopy to roll about the first roll end 70 relative to the second roll end 72. It is also to be appreciated that the awning 12 can include a plurality of adjustment devices 10, such as one for each end 70, 72 of the roll tube 18 to permit additional adjustment. It is also to be appreciated that the retainer element 46 can be used during the adjustment process to maintain the outer diameter (D) of the adjustment member 50 while the canopy 16 is rolled about the roll tube 18.

The invention has been described with reference to the preferred embodiments. Obviously, modifications and alterations will occur to others upon a reading and understanding of this specification. It is intended to include all such modifications and alterations insofar as they come within the scope of the appended claims or the equivalents thereof.

What is claimed is:

1. An adjustment device for an awning, comprising: an engagement member having a plurality of angular splines; a resilient adjustment member having an outer diameter and being adapted to engage the engagement member, wherein the angular splines are keyed into corresponding internal grooves of the adjustment member, and wherein the outer diameter of the adjustment member is adapted to be selectively adjustable; and a retainer element adapted to move along a longitudinal axis thereby moving the adjustment member with respect to the engagement member along the longitudinal axis and maintain a desired outer diameter of the adjustment member.

2. The adjustment device of claim 1, wherein the adjustment member further comprises a plurality of support members and a plurality of flexible connectors, wherein each support member is connected to an adjacent support member by a flexible connector to form an enclosed cross-section.

3. The adjustment device of claim 2, wherein the flexible connector comprises a living hinge integrally connecting adjacent support members.

4. The adjustment device of claim 2, wherein the flexible connectors define the sides of the internal grooves.

5. The adjustment device of claim 2, wherein the flexible connectors permit adjacent support members to selectively adjust the outer diameter of the adjustment member from a minimum outer diameter to a maximum outer diameter.

6. The adjustment device of claim 5, wherein the resilient adjustment member is resiliently biased towards the minimum outer diameter such that each support member abuts an adjacent support member.

7. The adjustment device of claim 1, wherein the adjustment member is splinably engaged to the engagement member to rotate together with the engagement member.

8. The adjustment device of claim 7, wherein the outer diameter of the adjustment member increases as the adjustment member is moved towards the engagement member, and wherein the outer diameter of the adjustment member decreases as the adjustment member is moved away from the engagement member.

9. The adjustment device of claim 1, wherein the retainer element comprises a threaded fastener adapted to engage an anchor attached to the engagement member.

10. An adjustment device for an awning, comprising: an engagement member; a resilient adjustment member having an outer diameter and being adapted to engage the engagement member and having a plurality of support members and a plurality of flexible connectors, wherein each support member is connected to an adjacent support member by a flexible connector to form an enclosed cross-section, and wherein the outer diameter of the adjustment member is adapted to be selectively adjustable; and a retainer element adapted to move along a longitudinal axis thereby moving the adjustment member with respect to the engagement member and maintain a desired outer diameter of the adjustment member.

11. The adjustment member of claim 10, wherein the engagement member further comprises a plurality of angular splines, and wherein the angular splines are keyed into corresponding internal grooves of the adjustment member such that the engagement member rotates together with the engagement member.

12. The adjustment device of claim 11, wherein the flexible connectors define the sides of the internal grooves.

13. The adjustment device of claim 10, wherein the flexible connectors comprise living hinges integrally connecting adjacent support members.

14. The adjustment device of claim 10, wherein the flexible connectors permit adjacent support members to selectively adjust the outer diameter of the adjustment member from a minimum outer diameter to a maximum outer diameter.

15. The adjustment device of claim 14, wherein the resilient adjustment member is resiliently biased towards the minimum outer diameter such that each support member abuts an adjacent support member.

16. The adjustment device of claim 10, wherein the outer diameter of the adjustment member increases as the adjustment member is moved towards the engagement member, and wherein the outer diameter of the adjustment member decreases as the adjustment member is moved away from the engagement member.

17. An adjustment device for an awning, comprising: an engagement member having a plurality of angular splines; a resilient adjustment member having an outer diameter, a plurality of support members and a plurality of flexible connectors, wherein each support member is connected to an adjacent support member by a flexible connector to form an enclosed cross-section, wherein the angular splines are keyed into corresponding internal grooves of the adjustment member such that the resilient adjustment member is adapted to splinably engage the engagement member, and wherein the outer diameter of the adjustment member is adapted to be selectively adjustable; and a retainer element adapted to move along a longitudinal axis thereby moving the adjustment member with respect to the engagement member and maintain a desired outer diameter of the adjustment member.

18. The adjustment device of claim 17, wherein the flexible connectors comprise living hinges that permit adjacent support members to selectively adjust the outer diameter of the adjustment member from a minimum outer diameter to a maximum outer diameter.

19. The adjustment device of claim 18, wherein the resilient adjustment member is resiliently biased towards the minimum outer diameter such that each support member abuts an adjacent support member.

20. The adjustment device of claim 17, wherein the outer diameter of the adjustment member increases as the adjustment member is moved towards the engagement member, and wherein the outer diameter of the adjustment member decreases as the adjustment member is moved away from the engagement member.

21. The adjustment device of claim 1, wherein the angular splines include a ramped geometry such that a height of each spline increases gradually along the longitudinal axis of the engagement member.

22. The adjustment device of claim 21, wherein the adjustment member further comprises a plurality of support members and a plurality of flexible connectors, wherein each support member is connected to an adjacent support member by a flexible connector to form an enclosed cross-section, and wherein the support members are adapted to slide against the ramped geometry of the angular splines as the adjustment member is moved along the longitudinal axis thereby adjusting the outer diameter of the adjustment member.

23. The adjustment device of claim 11, wherein the support members include a ramped geometry such that a thickness of each support member increases gradually along a longitudinal axis of the adjustment member.

24. The adjustment device of claim 23, wherein the support members are adapted to slide against the angular splines along the ramped geometry as the adjustment member is moved along the longitudinal axis thereby adjusting the outer diameter of the adjustment member.

25. The adjustment device of claim 17, wherein at least one of the support members and the angular splines include a ramped geometry such that at least one of the thickness of the support members and the height of the angular splines increases gradually along a longitudinal axis.

26. The adjustment device of claim 25, wherein the support members are adapted to slide against the angular splines along the ramped geometry as the adjustment member is moved along the longitudinal axis thereby adjusting the outer diameter of the adjustment member.

* * * * *